US010709244B2

(12) United States Patent
Tristan

(10) Patent No.: US 10,709,244 B2
(45) Date of Patent: Jul. 14, 2020

(54) DYNAMIC FURNITURE ITEMS WITH INTERCHANGEABLE PANELS

(71) Applicant: Table Sayings LLC, Lubbock, TX (US)

(72) Inventor: Cody Tristan, Leander, TX (US)

(73) Assignee: Table Sayings LLC, Leander, TX (US)

( * ) Notice: Subject to any disclaimer, the term of this patent is extended or adjusted under 35 U.S.C. 154(b) by 0 days.

(21) Appl. No.: 16/143,269

(22) Filed: Sep. 26, 2018

(65) Prior Publication Data

US 2020/0093266 A1 Mar. 26, 2020

(51) Int. Cl.

| | |
|---|---|
| ***A47B 96/20*** | (2006.01) |
| ***A47B 13/08*** | (2006.01) |
| ***A47B 3/06*** | (2006.01) |
| ***A47C 4/03*** | (2006.01) |

(52) U.S. Cl.

CPC ..... *A47B 96/20* (2013.01); *A47B 3/06* (2013.01); *A47B 13/088* (2013.01); *A47C 4/03* (2013.01); *A47B 2096/207* (2013.01)

(58) Field of Classification Search

CPC . A47B 96/20; A47B 96/201; A47B 2096/204; A47B 2096/207; A47B 2096/208; A47B 3/06

See application file for complete search history.

(56) References Cited

U.S. PATENT DOCUMENTS

| | | | | |
|---|---|---|---|---|
| 2,687,537 | A * | 8/1954 | Wallace | A47C 19/022 5/280 |
| 3,688,707 | A * | 9/1972 | White | A47B 3/12 108/13 |
| 5,558,391 | A * | 9/1996 | Chavous | A47B 13/16 108/25 |
| 6,543,071 | B1 * | 4/2003 | Lenner | A47C 19/022 312/204 |
| 6,658,677 | B2 * | 12/2003 | Paul | A47C 19/022 16/417 |
| 7,004,082 | B2 * | 2/2006 | Yang | A47B 37/04 108/50.12 |
| 7,387,151 | B1 * | 6/2008 | Payne | E06B 5/006 160/371 |
| 9,468,289 | B2 * | 10/2016 | Sambonet | A47B 13/16 |
| 2005/0225216 | A1 * | 10/2005 | Kim | A47B 96/201 312/204 |
| 2013/0337220 | A1 * | 12/2013 | Janke | A47B 95/04 428/99 |
| 2016/0235201 | A1 * | 8/2016 | Soot | F21V 33/0012 |
| 2017/0156499 | A1 * | 6/2017 | Kane | A47B 96/20 |
| 2018/0271280 | A1 * | 9/2018 | Janke | A47B 95/04 |

* cited by examiner

*Primary Examiner* — Daniel J Rohrhoff
(74) *Attorney, Agent, or Firm* — Whitaker Chalk; Carder Brooks

(57) ABSTRACT

This application describes a unique design and a method for designing furniture items that incorporate removable panels to either decorate or alter the use of a standard furniture item. The proposed furniture items take the form of standard furniture items but have recessed areas or cavities incorporated into different portions of the structure. These cavities correspond to and fit different panels which display artwork or different utility elements. These panels can be interchanged between different furniture items of the similar design.

14 Claims, 7 Drawing Sheets

DYNAMIC FURNITURE ITEMS WITH INTERCHANGEABLE PANELS

CROSS-REFERENCE TO RELATED APPLICATIONS

None.

STATEMENT OF FEDERALLY SPONSORED RESEARCH OR DEVELOPMENT

None.

REFERENCE TO A SEQUENCE LISTING, A TABLE, OR A COMPUTER LISTING COMPACT DISC APPENDIX

None.

BACKGROUND OF THE INVENTION

The present invention is in the field of furniture. Specifically, the invention relates to dynamic furniture items that have interchangeable panels to lend decorative quality, utility, or other characteristics to the furniture items.

The appearance, character, and utility of specific rooms in homes and business locations are often greatly dependent on the furnishings. Furniture items are generally static elements that dictate how a room is perceived and used by the occupants. Generally, these furniture items are decorated with multiple effects (pictures, vases, trays, etc.) to achieve a desired theme or purpose. However, the furniture items themselves are largely unchangeable and cannot themselves be personalized without permanent alteration. For example, a dining table could not depict "Merry Christmas" on the table-top without some sort of permanent carving or painting; a headboard could not be decorated with "Sleep Tight" without implementing a lasting modification; and a coffee table could not secure a tray against sliding off the table-top after a bump or knock without some sort of scoring or other enduring adjustment. Consequently, if such changes are made, the owner has no ability to alter or undo them, limiting the potential to both display a variety of aesthetic designs and utilize the furniture piece in an alternative fashion.

There have been a number different attempts in the art to achieve some level of variety in furniture decoration and utility. U.S. Pat. No. 6,123,031A teaches the use of removable decorative panels to display different advertisements and/or game boards on a table. These panels can be slid in and out over the table top by removing a molding around the edge of the table, or alternatively, the panels can be adhered to the surface of the table top using double-sided tape. Additionally, special lock pins requiring special tools for manipulation can be used to secure the panels against unauthorized exchange. The '031A patent is limited, however, in that the whole table top must be cleared off before exchanging the panel; the panel lies over the table top to display the advertisement, and replacing it is impossible without first cleaning off the table. Additionally, the '031A patent contemplates only one panel per table, limiting the variety of what can be displayed on the table at any given time. This patent also does not provide for interchangeability of the decorative panel from a table to any other piece of furniture; panels are limited to being displayed only on the table top.

Another attempt in the art to lend variety to the aesthetic quality of a given furniture piece is seen in U.S. Pat. No. 7,722,123B2. This patent discloses the use of removable panels to decorate both a stool and a table. While the '123B2 patent provides for the use of a plurality of panels to change the aesthetic value, the panels are limited to the given furniture item; panels for stools remain with stools, and panels for tables remain with tables. The patent does not provide for interchangeability of panels from one furniture item to another. Additionally, the panels contemplated by the '123B2 patent are solely for aesthetic purposes and have no utility quality.

As another example, U.S. Pat. No. 3,688,707A teaches a different design for a table wherein the table top is composed of multiple panels that can vary in both composition and decorative value. The entire table top is a series of panels, some of which can in the form of recessed boxes allowing for the display of plants, ash trays, or art objects. While the '707A patent contemplates the use of multiple panels in a single table, it does not provide for the interchangeability of panels between multiple furniture pieces. Additionally, excepting the recessed box panel, no other utility elements are proposed as possible panels. The table of the '707A patent is limited to providing decorative panels or boxes for display.

Accordingly, there is a need in the art for dynamic furniture items that are easily adaptable to interchangeably display aesthetic designs or advertising material, or to securely exhibit useful elements such as trays, bowls, or game boards. These furniture items could be designed in sets, such that one interchangeable panel from one furniture item can be removed and subsequently displayed by another furniture item of the same set. Certain embodiments of the furniture items should allow for facile removal of the panels simultaneously with continued use of the items, unlike in the '031A patent; for example, if the furniture item were a table, the panels should be removable without requiring the entire table top to be cleared off and without requiring the added effort of removing side molding or double-sided tape.

SUMMARY OF THE INVENTION

In one embodiment, the disclosed invention is a novel design for furniture items that satisfies the above requirements and addresses failings in the art.

A furniture item of the disclosed invention comprises a furniture item structure, which may be the necessary base elements of any given piece of furniture without which the furniture item would not function. Furniture items such as dining tables, chairs, headboards, coffee tables, side tables, cabinets, chests of drawers, armoires, buffet stands, TV stands, bookshelves, and all other types of furniture pieces have necessary basic structures (i.e., where appropriate, each furniture item structure has a frame, legs, a top, a front, a back, sides, and then specific distinguishing characteristics such as drawers, shelves, doors, etc.). In one non-limiting embodiment, and as non-limiting examples of furniture item structures, the furniture item of the disclosed invention may be a table, wherein the furniture item structure comprises a table top, a frame (for example, comprising optional combinations of side stretchers, H stretchers, X stretchers, box stretchers, aprons, skirts, drop leaves) supporting said table top, and a leg or legs connected to the frame and/or table top. In another non-limiting embodiment, the furniture item of the disclosed invention may be a chair, wherein the furniture item structure comprises a seat, a frame (for example, comprising optional combinations of spindles, box stretchers, H stretchers, X stretchers, aprons, stiles) to support said seat, a back (for example, comprising optional combinations of top rails, cross rails, ears, arm rests, shoes) and legs to support the frame, seat, and back. In another non-limiting embodiment, the furniture item may be a headboard or footboard, wherein the furniture item structure comprises a board sized to fit a specific mattress, with a front, a back, and legs for support that optionally attach to a bed frame.

The furniture items of the disclosed invention may further comprise at least one cavity in at least one portion of the furniture item structure. The cavity may be a recessed portion of the furniture item structure, designed to fit panels of varying designs and utility. The cavity appears on at least one portion of the furniture item structure, and a portion of a furniture item structure refers to any specific part or element of the furniture item structure, such as (as appropriate) the legs, top, sides, back, drawers, or doors.

The furniture items of the disclosed invention may further comprise at least one panel that may be removably attached to or placed in at least one cavity of the furniture item structure. Each panel may be of varying size and have a front surface that faces outwardly from the furniture item structure such that the front surface of the panel is externally visible. Each panel may also have a back surface that faces inwardly towards the furniture item structure. Each panel may be sized to fit at least one cavity on at least one portion of the furniture item structure, such that the panel fits smoothly into the cavity. Each panel may vary in thickness, allowing the panel to be recessed somewhat into the furniture item structure, to stand out from the furniture item structure, or to be flush with the furniture item structure such that the panel is planar with the surface of the portion of the furniture item structure. Each panel may be selectively placed and/or attached into any given cavity of the correct size and shape on any given furniture item, such that panels are interchangeable from one furniture item to others with matching cavities. The panels may be placed into the cavities without any means for attachment as appropriate (i.e., into a table top, wherein gravity keeps the panel inside the cavity without a means for attachment), or the panels can be attached via magnets, Velcro, or any other means of temporary attachment that would allow for facile removal of the panel as needed.

The front surface of the panels may be decorative or feature utility elements. A front surface that is decorative may display any form of artwork, including, but not limited to, drawings, paintings, carvings, colorings, statues, sayings, memes, phrases, or any other type of decoration holding aesthetic or artistic value. A utility element that may be featured on the front surface of a panel may include, but is not limited to, a tray, cup holders, a game board, a bowl, a wine rack, a butter dish, a platter, a candelabra, or any other type of element that has some sort of quality beyond or in addition to aesthetic value.

The furniture items of the disclosed invention may be composed of any number of materials that furniture items structures may regularly be composed of. Materials may include, but are not limited to, wood, metal, composite, glass, plastic, fiberglass, plexiglass, or any other type of material that can manipulated or molded to form a furniture item structure. The panels of the disclosed invention may be composed of the same or different material as that of the furniture item structure the panels are removably attached to or placed in.

The furniture items of the disclosed invention may further allow for interchangeability of different panels from one furniture item to another. In one non-limiting embodiment, and as one non-limiting example, a furniture item taking the form of a table may have a cavity in the table top that fits a panel with a decorative front surface. Another furniture item taking the form of a headboard may have a cavity in the front face that fits the same panel that can be displayed on the table top. The panel in the table top cavity may be removed from the table top and removably attached to or placed in the cavity of the headboard, rendering the panel interchangeable between the table and the headboard.

The furniture items of the disclosed invention may further comprise racks, slots or, holders designed to hold panels that are not removably attached to or placed in a cavity of a furniture item. In one non-limiting embodiment, and as one non-limiting example, a furniture item taking the form of a table may have multiple slots below the table top that are sized to fit panels that are not being currently displayed or used in a furniture item cavity. One of these slots may, for example, hold a panel displaying "Merry Christmas" while it is not in use, and said panel may be removed from the slot and placed into an appropriately sized cavity in any furniture item.

In another embodiment, the disclosed invention is a method of customizing furniture items, comprising the steps of: creating furniture items with at least one cavity in at least one portion of the furniture item; fashioning multiple panels that may fit at least one cavity in at least one portion of the furniture item; and removably attaching at least one of said panels within at least one cavity in at least one portion of the furniture item. The furniture items of the disclosed method may be selected from a group consisting of: dining tables, chairs, headboards, coffee tables, side tables, cabinets, chests of drawers, armoires, buffet stands, TV stands, or bookshelves.

Each of at least one of the panels of the disclosed method may comprise a dorsal or anterior surface that faces outwardly from the furniture item and is externally visible when said panel is removably attached to or placed in at least one cavity of the furniture item. Such dorsal or anterior surface of at least one panel may be decorative, a utility element, or any combination thereof. In the claimed invention, at least one panel to be removably attached to or placed in at least one cavity of at least one portion of the furniture item may be the same shape and size as the cavity the panel may be removably attached to or placed in. At least one cavity of at least one furniture item structure may fit a multitude of different panels displaying ornamental designs, utility elements, or any combination thereof, and at least one panel may be removed from at least one cavity of at least one furniture item and subsequently removably attached to or placed in at least one cavity in at least one portion of at least one different furniture item.

BRIEF DESCRIPTION OF THE DRAWINGS

These and other features, aspects, and advantages of the present invention will become better understood with regard to the following descriptions, appended claims, and accompanying drawings where:

DETAILED DESCRIPTION OF THE INVENTION

Figure 1:
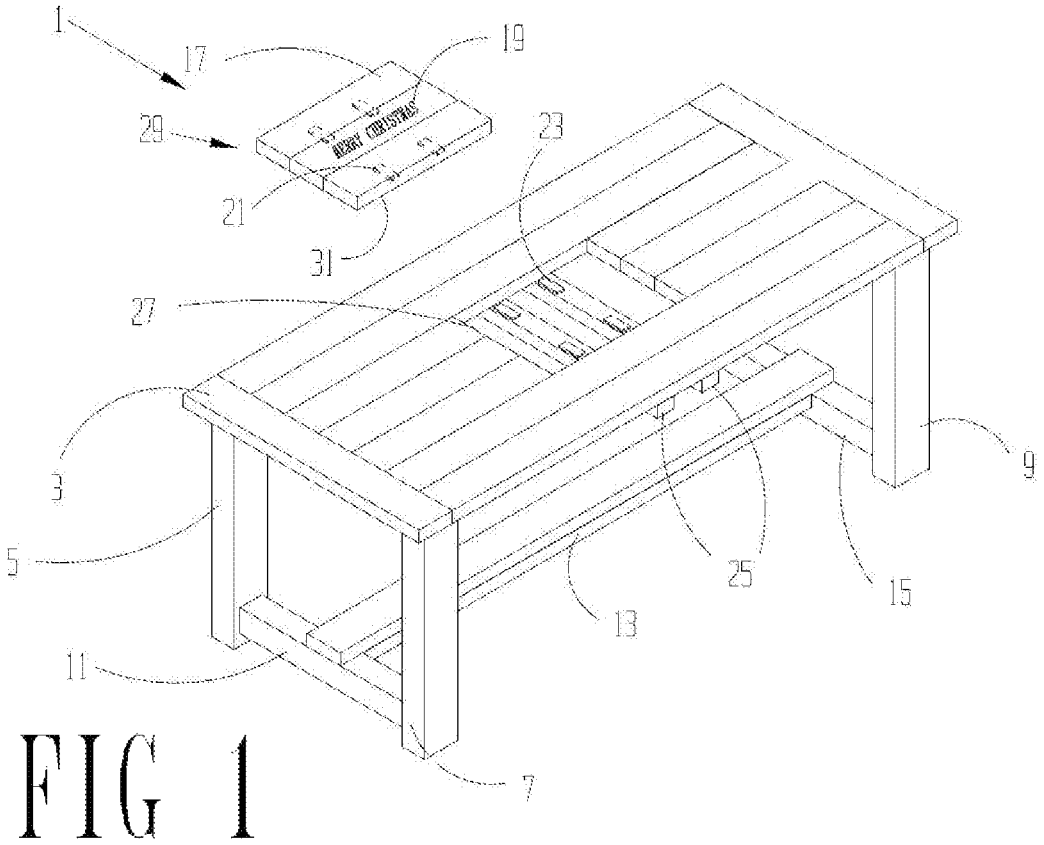
FIG. 1 shows a preferred embodiment of the claimed invention in which the furniture item is a table with a single cavity in the table top. The panel, as a non-limiting example, depicts "Merry Christmas."

In the Summary of the Invention above and in the Detailed Description of the Invention, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components.

Where reference if made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm.

FIG. 1 shows a preferred embodiment of the claimed invention in table form 1 with major components including the table top 3, a plurality legs 5, 7, 9 (fourth leg not visible and therefore not provided with a reference numeral), side stretchers 11, 13 and an H stretcher 15 that connects to the side stretchers 11, 13. These major components 3, 5, 7, 9 (fourth leg not visible), 11, 13, 15 make up the furniture item structure of this particular embodiment of the claimed invention in table form. The furniture item structure can be composed of any sturdy material capable of retaining a static shape, being composed of wood in this particular embodiment. The table top 3 can be of any shape and size, depicted as a rectangle in this particular embodiment. The plurality of legs may similarly be of any shape, size, or design, provided that they support the table top in sitting above the ground. The cavity 27 in the table top 3 is made to temporarily retain a panel 29. Like the table top 3, the cavity 27 can be of any shape, displayed here as a rectangle. In this particular embodiment, supports 25, preferably but not necessarily composed of the same material as the furniture item structure, run underneath the table top 3 and cavity 27 to support placement of the panel 29 into the cavity 27. The panel 29 can be of the same or different material as the furniture item structure, and it can be placed into any cavity of any furniture item structure that is sized to fit such panel; here, the panel 29 is rectangular and fits into a rectangular cavity 27. In this particular embodiment, the supports 25 have a means of attachment (here, magnets 23) that facilitate secure attachment of the panel 29 to the supports 25 via interactions between other magnets 21 on the ventral face of the panel 31. In this particular embodiment, the dorsal face of the panel 17 depicts a stylized "Merry Christmas" 19 as an aesthetic design. In other embodiments, other aesthetic or ornamental designs may be present. Additionally, in this embodiment and others, any furniture item may have multiple panels designed to fit in the same cavity of that furniture item. For example, in addition to the panel 29 depicted in FIG. 1, there may be another panel similarly sized that fits into the cavity 27 with a different ornamental design or utility element, such as a stylized "Happy Thanksgiving" or a tray.

Figure 2:
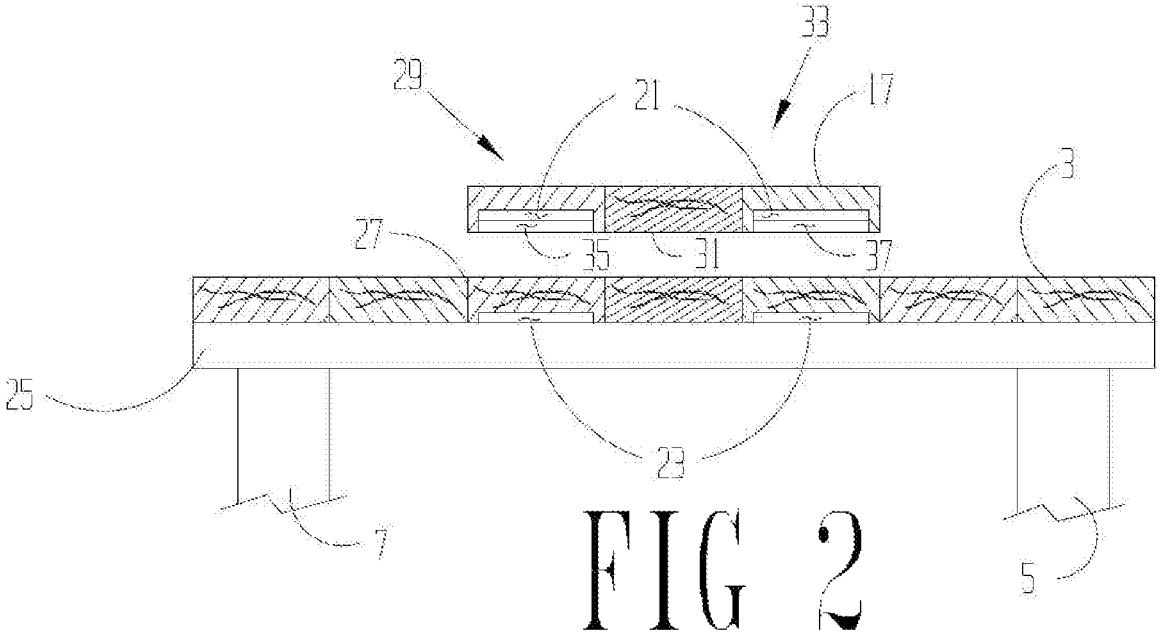
FIG. 2 shows a sectional view taken laterally of the preferred embodiment shown in FIG. 1.

FIG. 2 shows a sectional view taken laterally between the two supports 33 of the first preferred embodiment in table form depicted in FIG. 1. The ventral face of the panel 31 contains notches 35, 37 in which the magnets of the panel 21 sit and the magnets on the supports 23 fit into, such that, in this particular embodiment, when the panel 29 is placed into the cavity 27, the dorsal face of the panel 17 is flush with the table top 3. While in this particular embodiment, the panel 29 fits into the cavity 27 such that the dorsal face of the panel 17 is flush with the table top 3, in other embodiments, the notches 35, 37 may be removed, or the panel 29 may be of varying thickness, such that the dorsal face of the panel is not flush with the table top 3.

Figure 3:
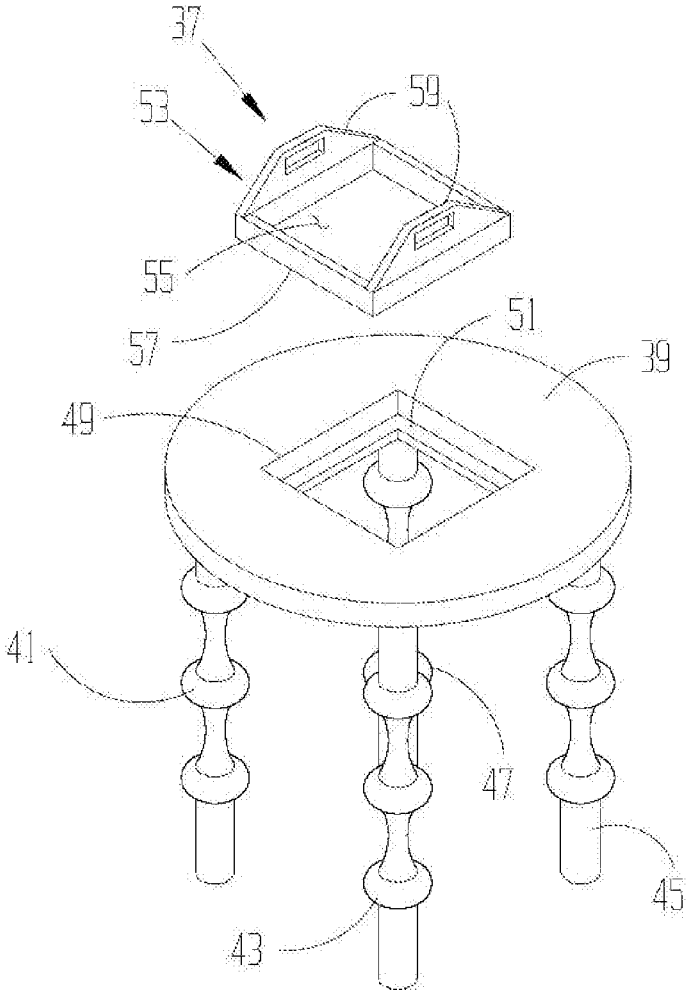
FIG. 3 shows a preferred embodiment of the claimed invention in which the furniture item is a table. The panel, as a non-limiting example, expresses a utility element in the form of a tray.

FIG. 3 depicts another preferred embodiment of the claimed invention. This particular embodiment is also in table form 37, with the major components including the table top 39 and a plurality of legs 41, 43, 45, 47, and these components 39, 41, 43, 45, 47 comprise the furniture item structure of this particular embodiment. The table top 39 can be of any shape or size, depicted here as being circular. The cavity 49 in the table top 39 is sized to fit a different panel 53 or panels than that of FIGS. 1 and 2. The lip 51 inside the cavity 49 supports the panel 53 when it is placed inside. Unlike in the embodiment of FIGS. 1 and 2, there are no means of attachment to secure the panel 53 inside the cavity 49 of the table top 39. Instead, gravity acts to secure the ventral face of the panel 57 to the lip 51 and keep the panel 53 in place once it is placed inside the cavity 49. The dorsal face of the panel 55, unlike the embodiment of FIGS. 1 and 2, houses a utility element in the form of a tray 59 with handles as opposed to an aesthetic or ornamental design. In other embodiments, other utility elements may be housed on the dorsal face of a given panel; additionally, the panel and cavity may be of different shapes and sizes than what is depicted in this particular embodiment. The ventral face of the panel 57 sits on the lip 51 inside the cavity 49 such that the dorsal face of the panel 55 is flush with the table top 39, and only the handles of the tray 59 protrude from the table top 39. In this embodiment and others, there may be multiple panels sized to fit the cavity 49 that depict different ornamental or aesthetic designs, or panels that display other utility elements such as a game board or candelabra.

Figure 4:
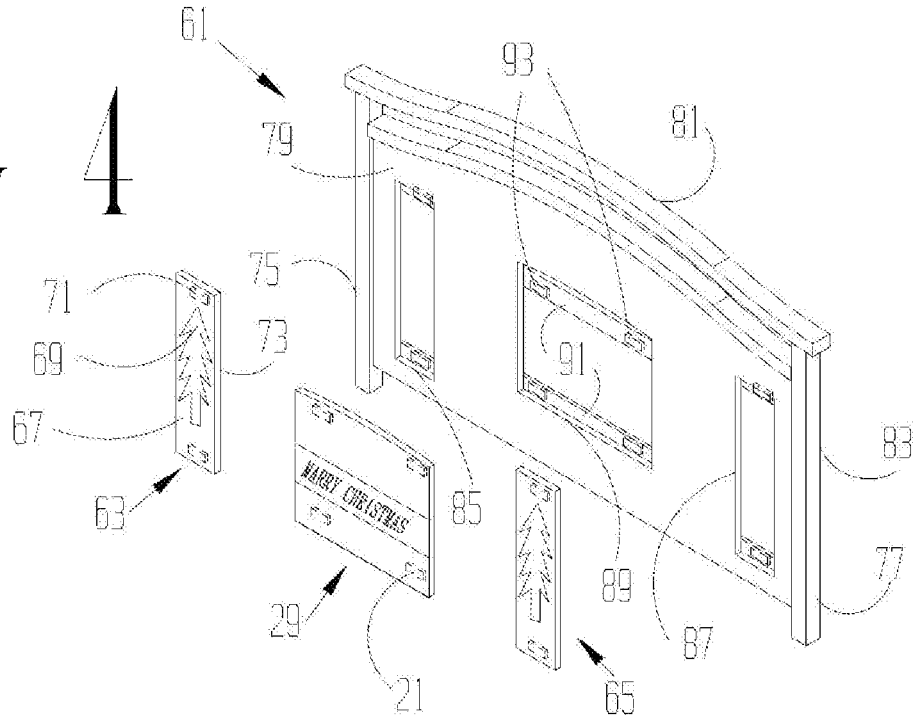
FIG. 4 shows a preferred embodiment of the claimed invention in which the furniture item is a headboard with multiple cavities designed to house different panels. The panel from FIG. 1 can be placed into a cavity of the headboard in FIG. 4.

FIG. 4 depicts the third preferred embodiment of the claimed invention in the form of a headboard 61. The major components include the anterior face of the headboard 79, two legs 75, 77, the top 81, and the posterior face (not visible, but referenced as 83); these components 75, 77, 79, 81, 83 comprise the furniture item structure of this preferred embodiment. In this particular embodiment, the panel 29 that fits into the cavity 89 of the headboard 61 is the same panel that fits into the cavity of the table in FIG. 1. This is an example of how panels may be interchanged between furniture pieces having cavities of similar sizes. In addition to having a cavity 89 that temporarily retains the larger panel 29, this particular embodiment has two additional cavities 85, 87 that house different panels 63, 65. Two supports 91 running parallel to the ground are attached to the posterior face of the headboard 83, and, similar to FIG. 1, these supports 91 have magnets 93 that correspond to different magnets 21, 71 on the posterior faces of the appropriate panels 63, 65, 29. The panels 63, 65 that fit into the smaller cavities 85, 87 are similar in design to the panel 29 depicted here and in FIG. 1, such that the posterior faces 73 houses magnets 71 inside of notches (not visible and therefore not provided with a reference numeral) where the corresponding magnets of the supports 93 fit into, rendering the anterior faces of the panels 67 to be flush with the anterior face of the headboard 79 when the panels 63, 65 are inserted into the cavities 85, 87. The smaller panels 63, 65 have aesthetic designs of Christmas trees 69 on the anterior faces 67. In this embodiment and others, there may be multiple panels (not depicted) designed to fit in the same cavity of a given furniture item. For example, in this particular embodiment, there may be a panel housing a battery-powered reading light on the anterior face that fits into one of the smaller cavities 85, 87, or a panel with a different aesthetic design.

Figure 5:
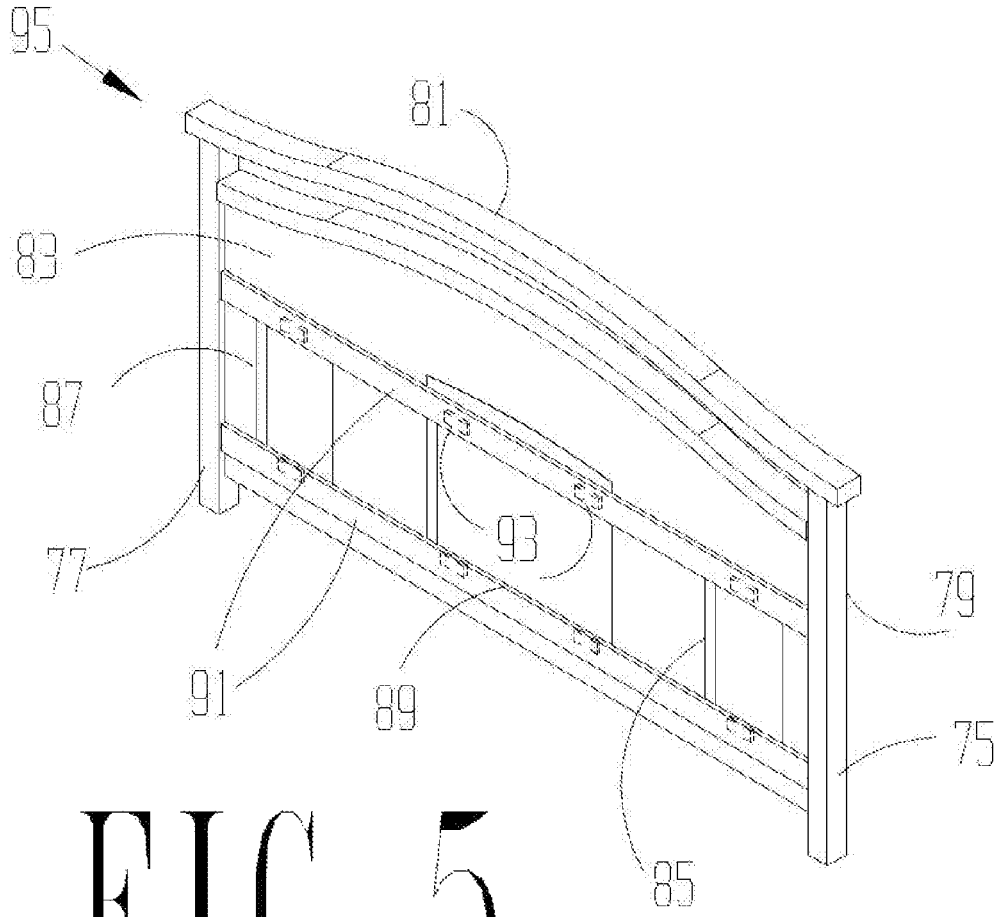
FIG. 5 shows a perspective view of the headboard in FIG. 4.

FIG. 5 is a perspective view of same preferred embodiment as FIG. 4. This perspective view of the headboard 95 shows the supports 91 running parallel to the floor along the posterior face of the headboard 83, secured behind the cavities 85, 87, 89 and housing magnets 93 for the appropriate panels to attach to.

Figure 6:
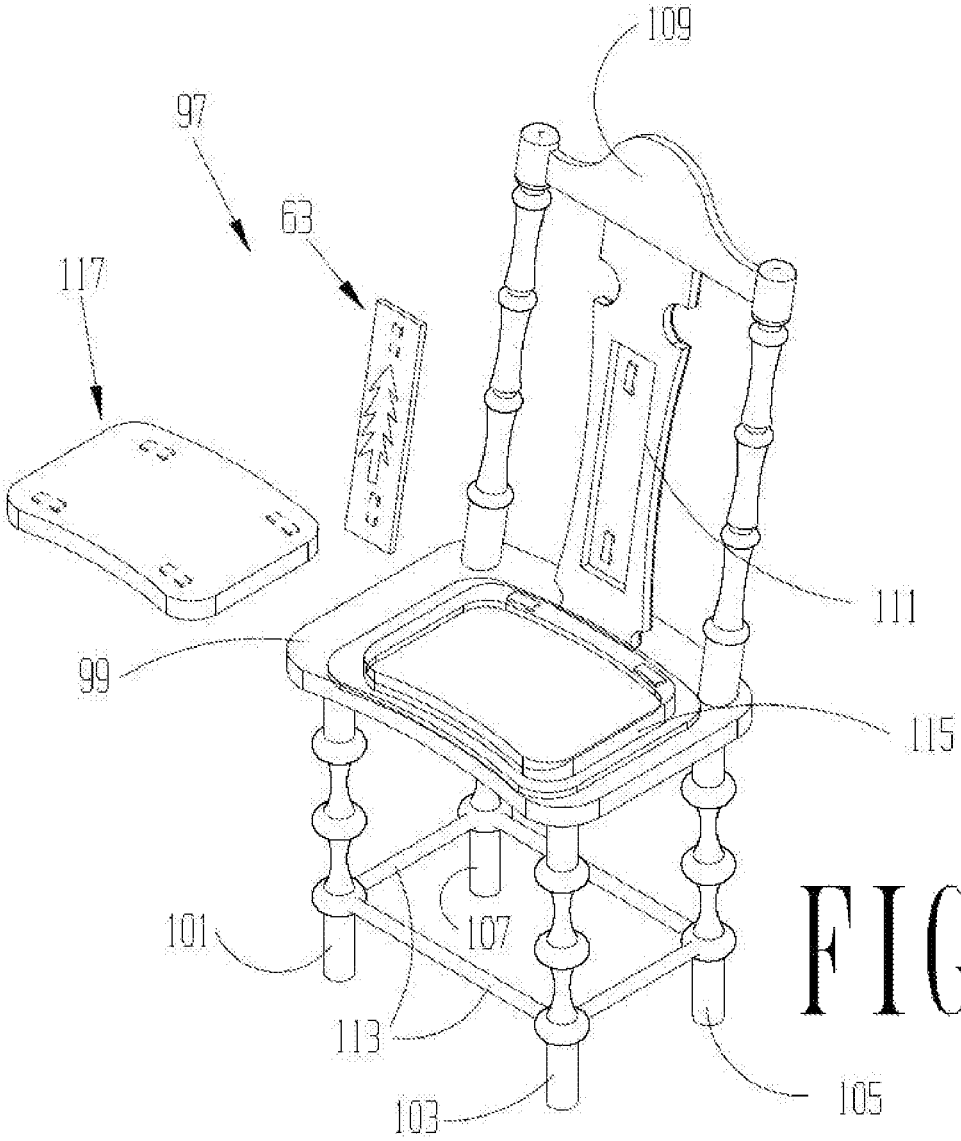
FIG. 6 shows a preferred embodiment of the claimed invention in which the furniture item is a chair with multiple cavities designed to house different panels. One of the smaller panels from FIG. 4 can be placed into one of the cavities of the chair in FIG. 6.

FIG. 6 shows the fourth preferred embodiment of the claimed invention in chair form 97. The major components include a seat 99, legs 101, 103, 105, 107, a back 109, and spindles 113. The furniture item structure of this embodiment comprises these major components 99, 101, 103, 105, 107, 109, 113. There are two cavities 111, 115 in this embodiment that house different panels 63, 117. The panel 63 that goes into the cavity 111 in the back of the chair is the same panel from FIG. 4, again showing that panels can be interchanged from one furniture piece to another having a cavities(s) of similar size. The panels 63, 117 attach to the chair in this embodiment with magnets similarly to FIG. 1 and FIG. 4. In this and other embodiments, there may be other panels (not shown) that fit into the cavities in the seat 115 and the back of the chair 111 that depict different ornamental designs, cushions, or other utility elements. If so desired, these other panels may be placed into different cavities in different furniture items as well.

Figure 7:
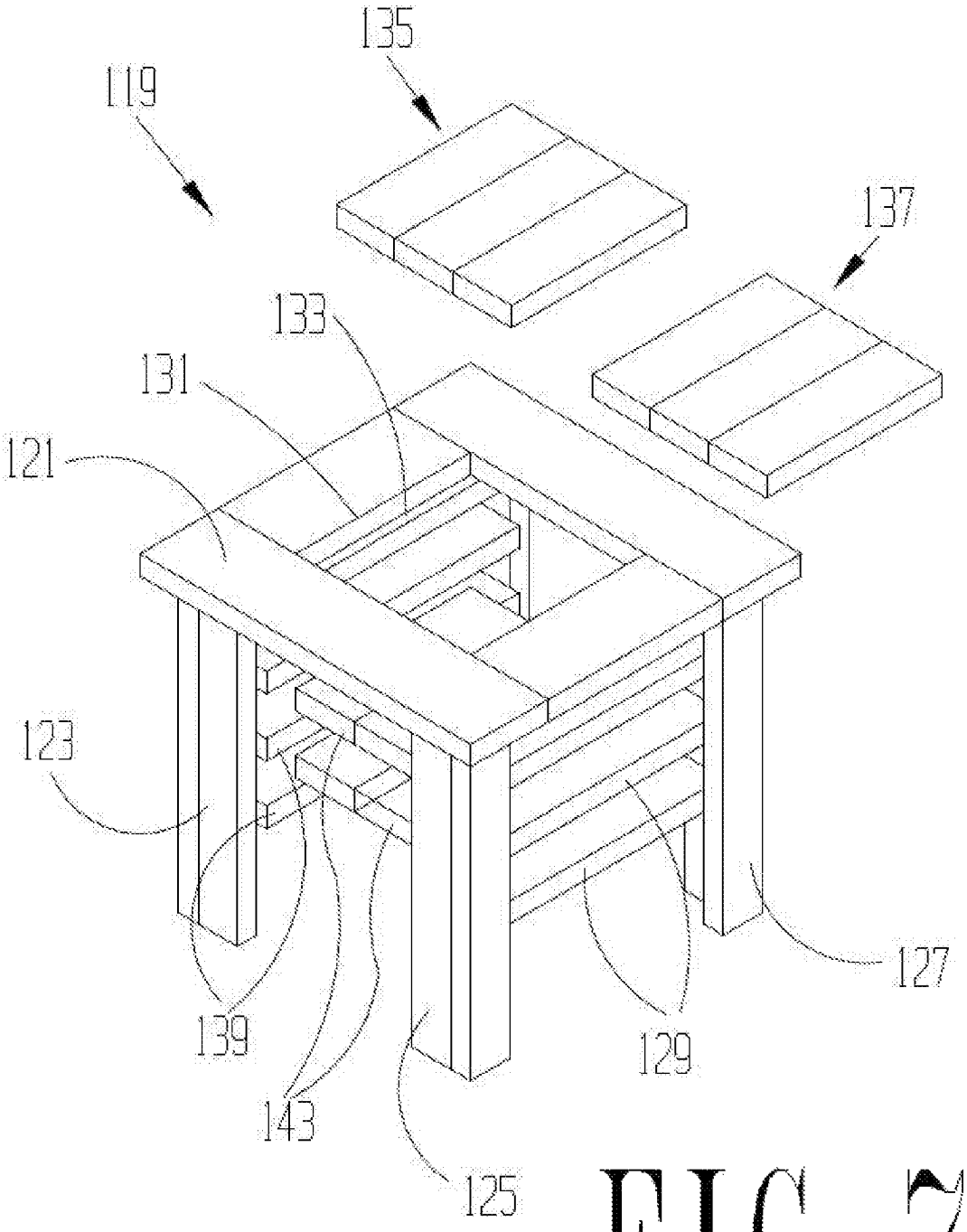
FIG. 7 shows a preferred embodiment of the claimed invention in which the furniture item is an end table with slots located below the table top designed to house appropriately sized panels when said panels are not displayed in a cavity of a furniture item structure.

FIG. 7 shows the fifth preferred embodiment of the claimed invention in table form 119. The major components include a table top 121, a plurality of legs 123, 125, 127 (fourth leg not visible and therefore not provided with a reference numeral), and side stretchers 129. These major components 119, 121, 123, 125, 127 (fourth leg not visible), 129 make up the furniture item structure of this particular embodiment in table form. The furniture item structure can be composed of any sturdy material capable of retaining a static shape, being composed of wood in this particular embodiment. The table top 121 can be of any shape and size, depicted as a rectangle in this particular embodiment. The plurality of legs may similarly be of any shape, size, or design, provided that they support the table top in sitting above the ground. The lip 133 inside the cavity 131 supports a myriad of panels 135, 137, 141 when such a panel is placed inside. Like in FIG. 3, there are no means of attachment to secure the panels 135, 137, 141 inside the cavity 131 of the table top 121. In this particular embodiment, slots 139 are incorporated into the furniture item under the table top 121 to house appropriately sized panels, such as the panels 135, 137, 141 shown. The side stretches 129 on each side of the table form protrusions on the underside of table between the legs 123, 125, 127 that allow unused panels 141 to slide in and rest in the slots 139 resulting from said protrusions. In this manner, unused panels 141 can be stored when not in use. In other embodiments, racks, slots, or holders may be incorporated into different furniture items in different manners. For example, for an embodiment in table form, multiple spindles may run underneath the seat and create slots similar to this embodiment, and different panels may be stored in such slots when not in use.

What is claimed is:

1. A customizable table comprising:

a leg;

a top comprising a cavity;

a first panel configured to removably engage within the cavity, the first panel comprising a face and a back wherein the face is displayed from the cavity when the first panel is removably engaged within the cavity; and a second panel configured to removably engage within the cavity, the second panel comprising a face and a back wherein the face is displayed from the cavity when the second panel is removably engaged within the cavity;

wherein the first panel and the second panel engage with and are removable from the cavity at an angle perpendicular to the plane of the cavity; and wherein the first panel and the second panel are not simultaneously engageable within the cavity.

2. The customizable table of claim 1, wherein the face of the first panel comprises a decoration or a utility element.

3. The customizable table of claim 1, wherein the face of the second panel comprises a decoration or a utility element.

4. The customizable table of claim 1, further comprising a rack disposed underneath the top configured to house the first panel and second panel when the first panel and the second panel are not removably engaged within the cavity.

5. The customizable table of claim 1, wherein the first panel and second panel are removably secured within the cavity via an attachment mechanism.

6. A method of customizing furniture items, the method comprising the steps of:

providing a first panel comprising a face and a back;

providing a second panel comprising a face and a back;

providing a first furniture item with a first cavity configured to selectively receive the first and second panel; and providing a second furniture item with a second cavity configured to selectively receive the first and second panel;

wherein the first panel and the second panel engage with and are removable from the first cavity and the second cavity at an angle perpendicular to the planes of the cavities;

wherein the first panel and the second panel are not simultaneously engageable within the first cavity;

wherein the first panel and the second panel are not simultaneously engageable within the second cavity; and wherein the first panel and the second panel are interchangeable between the first cavity and the second cavity.

7. The method of claim 6, wherein the first furniture item is selected from a group consisting of: a table, a chair, a headboard, a cabinet, a chest, an armoire, a buffet stand, a TV stand, and a bookshelf.

8. The method of claim 6, wherein the second furniture item is selected from a group consisting of a table, a chair, a headboard, a cabinet, a chest, an armoire, a buffet stand, a TV stand, and a bookshelf.

9. The method of claim 6, wherein the face of the first panel is decorative or a utility element.

10. The method of claim 6, wherein the face of the second panel is decorative or a utility element.

11. The method of claim 6, wherein the first panel and second panel are removably secured within the first cavity and the second cavity via an attachment mechanism.

12. A customizable furniture system comprising:

a panel comprising a face and a back;

a first furniture item with a first cavity configured to receive the panel; and a second furniture item with a second cavity configured to receive the panel;

wherein the panel is selectively and removably engagable within the first cavity such that the face of the panel is displayed from the first cavity;

wherein the panel is selectively and removably engagable within the second cavity such that the face of the panel is displayed from the second cavity;

wherein the panel engages with and is removable from the first cavity at an angle perpendicular to the plane of the first cavity;

wherein the panel engages with and is removable from the second cavity at an angle perpendicular to the plane of the second cavity;

wherein the first furniture item is selected from the group consisting of: a table, a chair, a headboard, a cabinet, a chest, an armoire, a buffet stand, a TV stand, and a bookshelf; and wherein the second furniture item is selected from the group consisting of: a table, a chair, a headboard, a cabinet, a chest, an armoire, a buffet stand, a TV stand, and a bookshelf.

13. The system of claim 12, wherein the face comprises a decoration.

14. The system of claim 12, wherein the face comprises a utility element.

* * * * *